US007976197B2

(12) United States Patent
Chen

(10) Patent No.: US 7,976,197 B2
(45) **Date of Patent: *Jul. 12, 2011**

(54) LIGHT-EMITTING DIODE ILLUMINATING EQUIPMENT WITH HIGH POWER AND HIGH HEAT DISSIPATION EFFICIENCY

(75) Inventor: Jen-Shyan Chen, Hsinchu (TW)

(73) Assignee: Neobulb Technologies, Inc. (BN)

( * ) Notice: Subject to any disclaimer, the term of this patent is extended or adjusted under 35 U.S.C. 154(b) by 131 days.

This patent is subject to a terminal disclaimer.

(21) Appl. No.: 12/227,867

(22) PCT Filed: May 31, 2006

(86) PCT No.: PCT/CN2006/001166

§ 371 (c)(1),
(2), (4) Date: Dec. 1, 2008

(87) PCT Pub. No.: WO2007/143875

PCT Pub. Date: Dec. 21, 2007

(65) Prior Publication Data

US 2009/0244895 A1 Oct. 1, 2009

(30) Foreign Application Priority Data

May 30, 2006 (CN) ..... 2006 1 0084276

(51) Int. Cl.
*F21V 29/00* (2006.01)

(52) U.S. Cl. ..... 362/294; 362/249.02; 362/373

(58) Field of Classification Search ..... 362/97.03, 362/183, 184, 186, 190, 218, 223, 224, 227, 362/230, 231, 240, 249.01, 249.02, 294, 362/310, 311.02, 373, 410, 414, 547, 550, 362/559, 800, 806–809; 313/12, 46
See application file for complete search history.

(56) References Cited

U.S. PATENT DOCUMENTS

| | | | | |
|---|---|---|---|---|
| 5,857,767 | A | 1/1999 | Hochstein | |
| 6,250,774 | B1 * | 6/2001 | Begemann et al. | 362/231 |
| 6,321,452 | B1 * | 11/2001 | Lin | 29/890.032 |
| 6,554,451 | B1 | 4/2003 | Keuper | |
| 6,942,361 | B1 * | 9/2005 | Kishimura et al. | 362/240 |
| 7,278,761 | B2 * | 10/2007 | Kuan | 362/294 |
| 2005/0180142 | A1 | 8/2005 | Tsai | |
| 2006/0092666 | A1 | 5/2006 | Jeong | |

FOREIGN PATENT DOCUMENTS

CN 2718774 Y 5/2004

(Continued)

OTHER PUBLICATIONS

Office Action in related Russian patent application dated Feb. 10, 2010.

(Continued)

*Primary Examiner* — Hargobind S Sawhney

(74) *Attorney, Agent, or Firm* — Thomas, Kayden, Horstemeyer & Risley, LLP.

(57) ABSTRACT

The invention provides a LED illuminating equipment with high power and high heat-dissipating efficiency. The LED illuminating equipment of the invention includes a plurality of diode light-emitting apparatuses. Particularly, the heat generated by the diode light-emitting apparatuses in operation is conducted to a heat-dissipating plate device and the heat-dissipating fins. Besides, the heat is uniformly distributed over the heat-dissipating plate device and further dissipated by the heat-dissipating plate device and the heat-dissipating fins extending thereon.

16 Claims, 8 Drawing Sheets

FOREIGN PATENT DOCUMENTS

| | | | |
|---|---|---|---|
| CN | 1560672 | A | 6/2004 |
| CN | 1680749 | A | 10/2004 |
| CN | 2743689 | Y | 10/2004 |
| CN | 2750186 | Y | 12/2004 |
| EP | 1139019 | | 10/2001 |

OTHER PUBLICATIONS

European Search Report in related application dated Jun. 23, 2010.
International Search Report for PCT/CN2006/001166 mailed Mar. 15, 2007.

* cited by examiner

LIGHT-EMITTING DIODE ILLUMINATING EQUIPMENT WITH HIGH POWER AND HIGH HEAT DISSIPATION EFFICIENCY

BACKGROUND OF THE INVENTION

1. Field of the Invention

The invention relates to a light-emitting diode (LED) illuminating equipment, and particularly relates a LED illuminating equipment with high power and high heat-dissipation efficiency, and the LED illuminating equipment has a structure equipped with water-proof, heat-isolation, and uniform heat distribution.

2. Description of the Prior Art

Because LED has advantages of low power consumption, shock-proof, fast response, and suitability for mass production, the research and development of the lighting equipment with the LED is continuously being carried on. Please refer to FIG. 1A and FIG. 1B. FIG. 1A is a front view of an illuminating equipment with a number of LEDs arranged into a matrix. FIG. 1B is a cross-section view of the illuminating equipment shown in FIG. 1A along W-W line. As shown in FIG. 1A and FIG. 1B, the illuminating equipment provides brighter illumination by a number of LEDs arranged into a matrix, such that the illuminating equipment is suitable for the illumination application. However, the development of the illuminating equipment mostly focuses on how to control the direction of light to achieve higher brightness, not on how to conduct heat or dissipate heat, as shown in U.S. Pat. No. 6,554,451. Currently, if the high-power LED continuously lights for a period of time, a problem of over-heat occurs; further, the lighting efficiency of the LED decreases and the brightness of the LED can not be raised. It is thus indicated that high-power LEDs in every application needs a mechanism for quickly conducting or dissipating heat. In addition, when the illuminating equipment is in operation, the traditional illuminating equipment with a number of LEDs generates a problem of non-uniform heat-distribution. As a result, the LEDs disposed inside the illuminating equipment and exposed under the heat-impact have a decaying opto-electrical efficiency. Furthermore, if the heat generated by the LEDs in operation can not be effectively isolated to prevent the heat from being radiated or conducted to a light-emitting area, the lighting efficiency of the LEDs will be lowered under the heat-impact generated by them.

Accordingly, a scope of the invention is to provide a LED illuminating equipment with high power and high heat-dissipating efficiency. Particularly, according to the LED illuminating equipment of the invention, a heat-conducting structure of the LED illuminating equipment can quickly and uniformly distribute the heat generated by the LEDs in operation and effectively isolate the heat out of the illuminating area.

Besides, the illuminating equipment with a number of high-power LEDs needs a water-proof design in an outdoor environment, for example, a streetlamp.

Therefore, another scope of the invention is to provide a LED illuminating equipment with high power and high heat-dissipating efficiency; particularly, the LED illuminating equipment has a water-proof design.

SUMMARY OF THE INVENTION

According to a preferred embodiment of the invention, a LED illuminating equipment includes a heat-dissipating plate device, N first heat-conducting devices, N diode light-emitting apparatuses, a hollow barrel, and a transparent shield. N is a natural number. The heat-dissipating plate device includes a first surface and a second surface opposite to the first surface. A number of heat-dissipating fins extend from the second surface. Each of the first heat-conducting devices is divided into a first part and a second part extending from the first part. The second part includes a flat end. Each of the diode light-emitting apparatuses corresponds to one of the N first heat-conducting devices, and is flatly mounted on the flat end of the corresponding first heat-conducting device for converting electrical energy into light. The heat generated by each of the diode light-emitting apparatuses in operation is conducted from the flat end through the second part and the first part of the corresponding first heat-conducting device to the heat-dissipating plate device and the heat-dissipating fins, so as to be dissipated by the heat-dissipating plate device and the heat-dissipating fins. The hollow barrel is engaged to a circumference of the heat-dissipating plate device, so as to expose the heat-dissipating fins to air and form an interior space for accommodating the first heat-conducting devices and the diode light-emitting apparatuses. The transparent shield is configured to engage to an opening formed by the hollow barrel engaged to the heat-dissipating plate device, so as to seal the interior space.

According to the preferred embodiment of the invention, the LED illuminating equipment further includes a heat-isolating plate device. The heat-isolating plate device thereon includes N first through holes, and each of the first through holes corresponds to one of the diode light-illuminating apparatuses. The heat-isolating plate device is disposed in the hollow barrel to separate the interior space into a first room and a second room, such that each of the diode light-emitting apparatuses passes through the corresponding first through hole to be disposed in the second room. The first parts of the first heat-conducting devices are disposed in the first room, and the heat generated by each of the diode light-emitting apparatuses mostly is isolated by the heat-isolating plate device for preventing the heat from being radiated or conducted to the second room.

Besides, according to the preferred embodiment, the LED illuminating equipment further includes a heat-isolating ring. The hollow barrel is engaged to the circumference of the heat-dissipating plate device via the heat-isolating ring, so as to isolate the heat conducted to the heat-dissipating plate device to prevent the heat from being conducted to the hollow barrel. By doing so, the LED illuminating equipment will not have a non-uniform heat-distribution, and further the heat-dissipating efficiency can be raised. In addition, the heat-isolating ring can prevent liquid from permeating into the LED illuminating equipment, so the LED illuminating equipment is equipped with water-proof.

Therefore, according to the embodiment of the invention, the LED illuminating equipment has a better heat-dissipating efficiency, and liquid can be prevented from permeating into the LED illuminating equipment. Accordingly, the LED illuminating equipment of the invention is suitable for a street lighting apparatus.

The advantage and spirit of the invention may be understood by the following recitations together with the appended drawings.

BRIEF DESCRIPTION OF THE APPENDED DRAWINGS

DETAILED DESCRIPTION OF THE INVENTION

A main scope of the invention is to provide a LED illuminating equipment with high power and high heat-dissipating efficiency. According to the invention, the LED illuminating equipment has a structure equipped with water-proof, heat-isolation and uniform heat distribution.

Figure 1A:
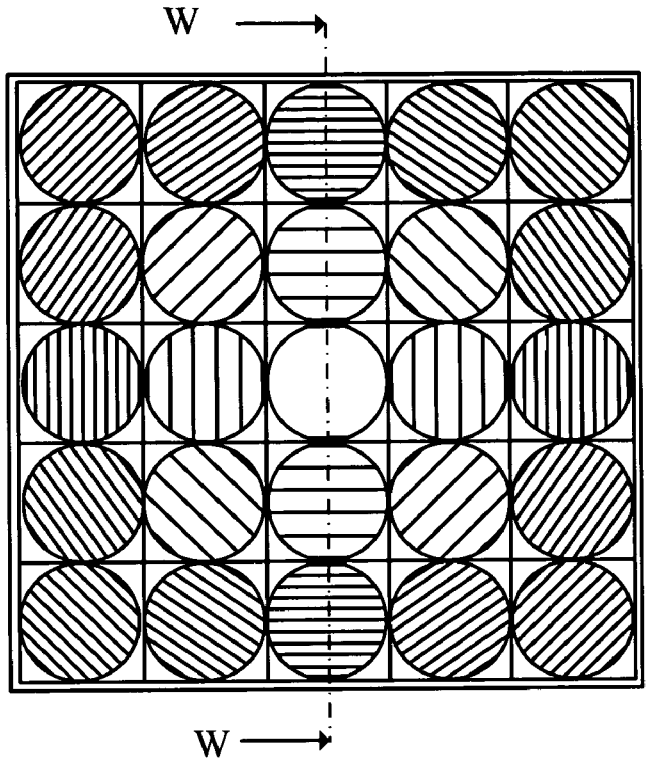
FIG. 1A (prior art)
FIG. 1A is a front view of an illuminating equipment with a number of LEDs arranged into a matrix.
Figure 1B:
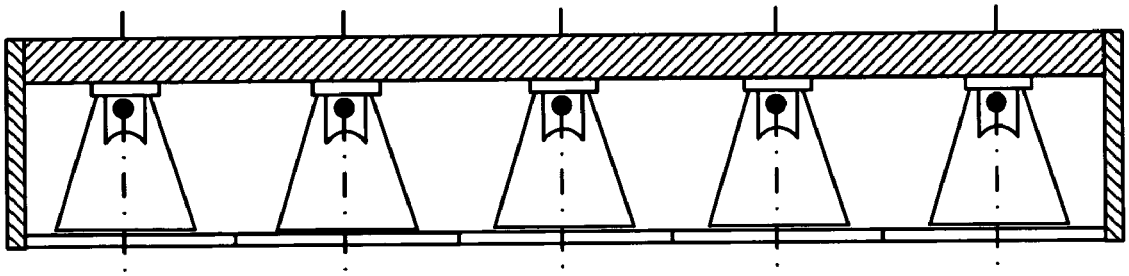
FIG. 1B (prior art)
FIG. 1B is a cross-section view of the illuminating equipment shown in FIG. 1A along W-W line.
Figure 2:
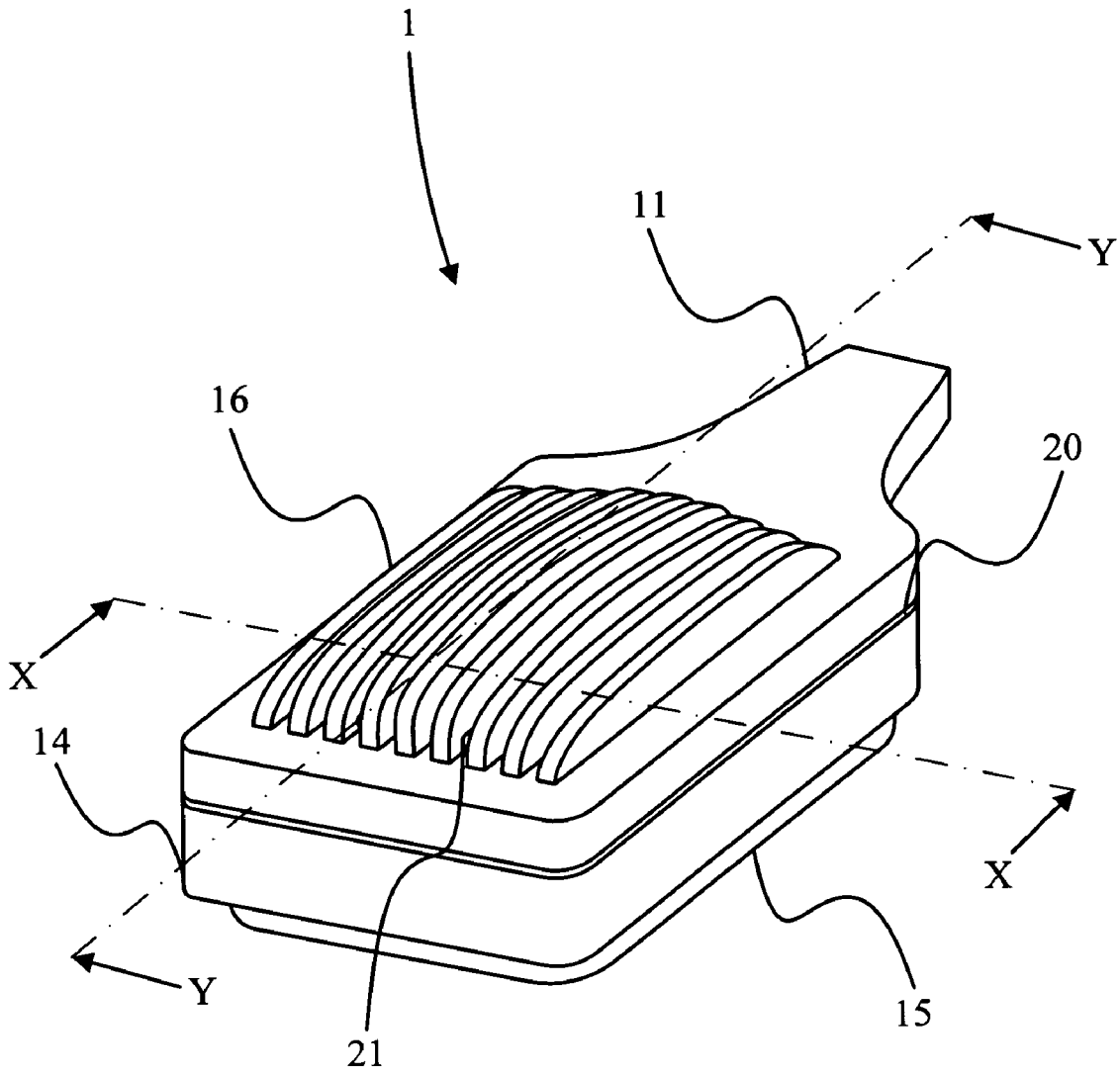
FIG. 2 is an exterior view of a LED illuminating equipment according to a preferred embodiment of the invention.
Figure 3:
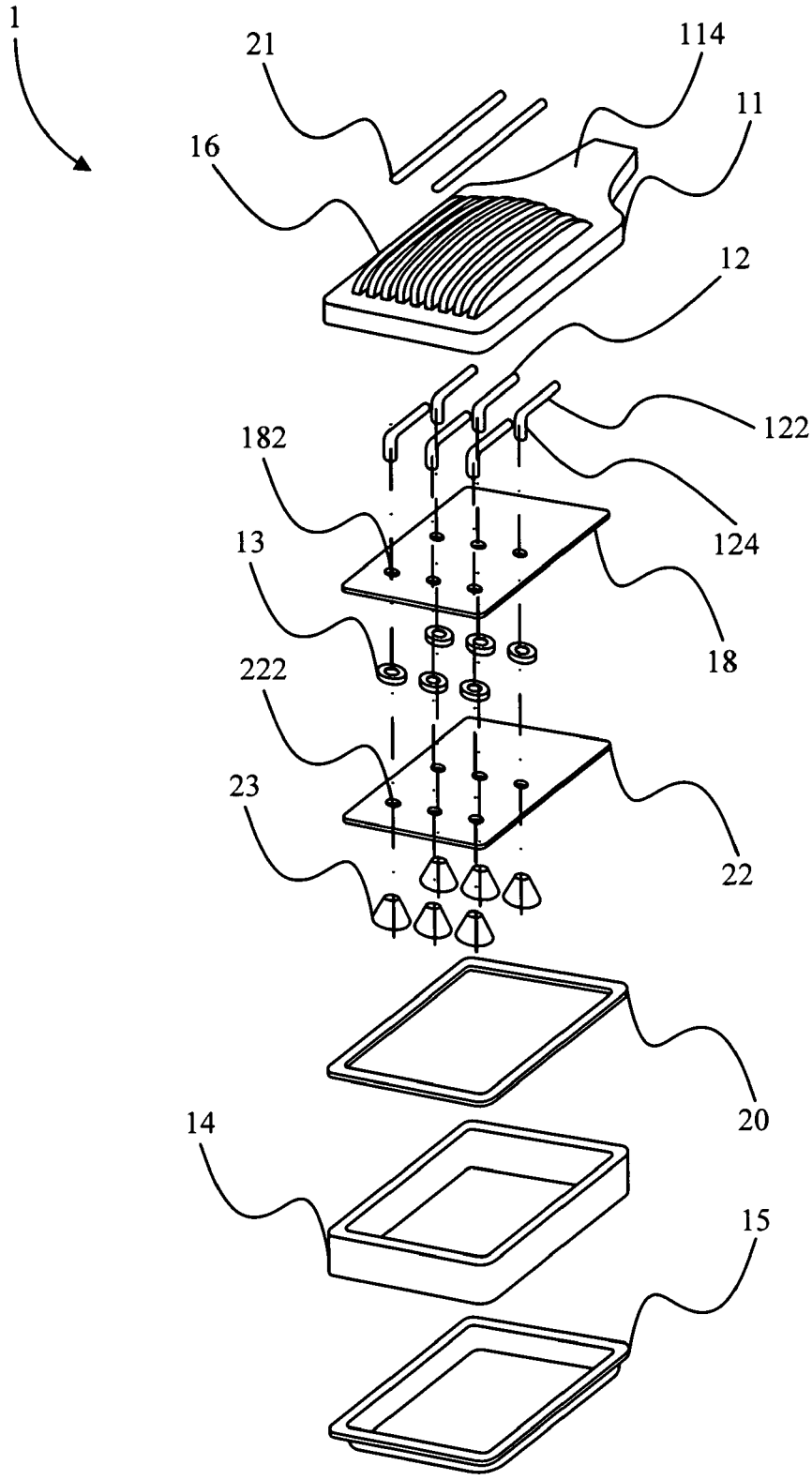
FIG. 3 is an explosion view of the main parts of the LED illuminating equipment according to the preferred embodiment.
Figure 4A:
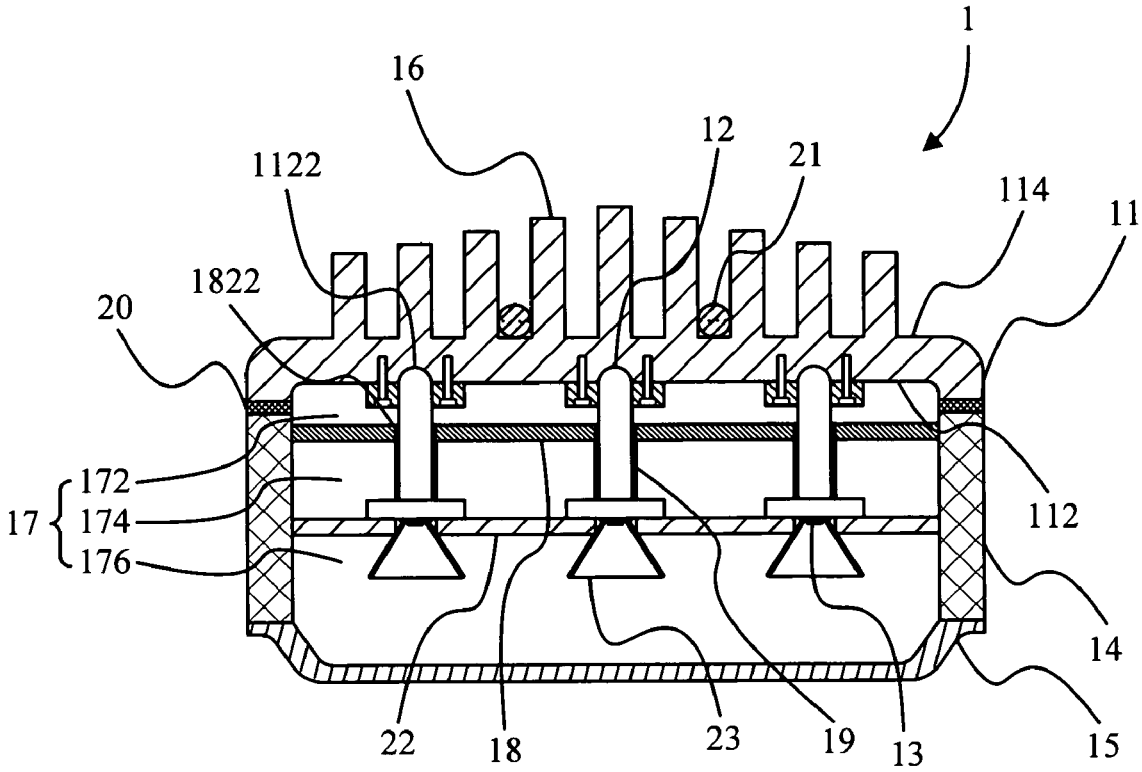
FIG. 4A is a cross-section view of the LED illuminating equipment shown in FIG. 2 along X-X line.
Figure 4B:
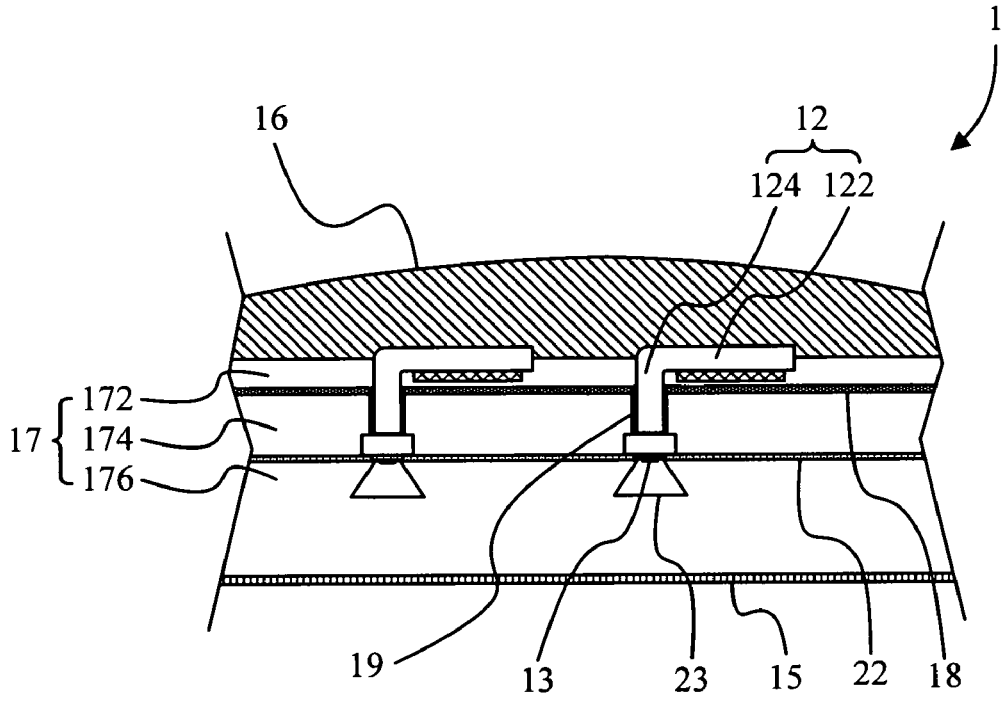
FIG. 4B is a local cross-section view of the LED illuminating equipment shown in FIG. 2 along Y-Y line.

Please refer to FIG. 2, FIG. 3, FIG. 4A, and FIG. 4B. FIG. 2 is an exterior view of a LED illuminating equipment 1 according to a preferred embodiment of the invention. FIG. 3 is an explosion view of main parts of the LED illuminating equipment 1 according to the preferred embodiment. FIG. 4A is a cross-section view of the LED illuminating equipment 1 shown in FIG. 2 along X-X line. FIG. 4B is a local cross-section view of the LED illuminating equipment 1 shown in FIG. 2 along Y-Y line.

According to the preferred embodiment of the invention, the LED illuminating equipment 1 includes a heat-dissipating plate device 11, N first heat-conducting devices 12, N diode light-illuminating apparatus 13, a hollow barrel 14, and a transparent shield 15, and N is a natural number. The heat-dissipating plate device 11 includes a first surface 112 and a second surface 114 opposite to the first surface 112. A number of heat-dissipating fins extend on the second surface 114.

Figure 4C:
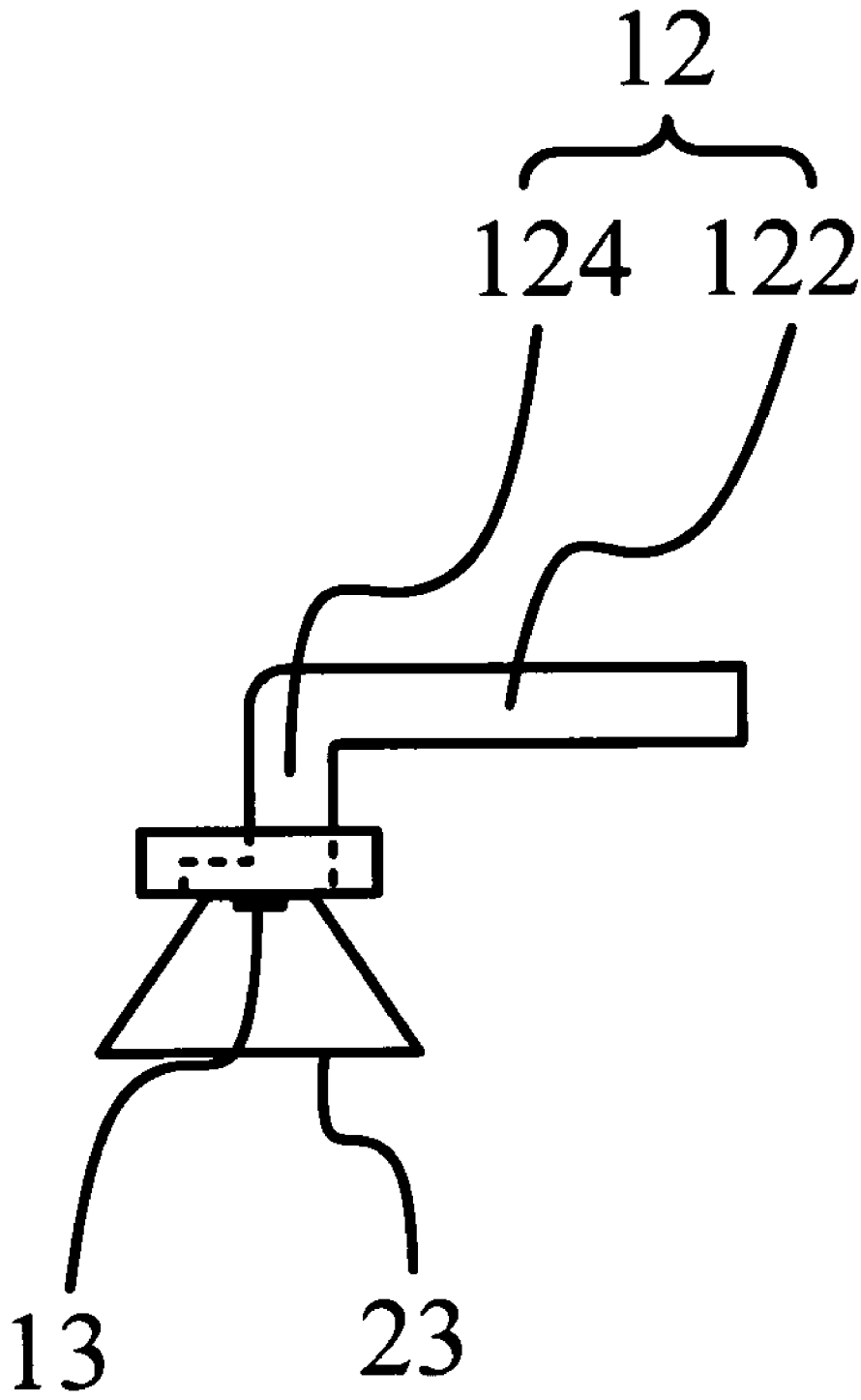

Each of the first heat-conducting devices 12 is divided into a first part 122 and a second part 124 extending from the first part 122. The second part 124 has a flat end 126. The flat end 126 is formed on one end of the second part 124, as shown in FIG. 4B. Or, the flat end 126 is formed by bending and flattening the end of the second part 124, as shown in FIG. 4C.

It should be remarked that each of the diode light-emitting apparatuses 13 corresponds to one of the N first heat-conducting devices 12. Each of the diode light-emitting apparatuses 13 is flatly mounted on the flat end 126 of the corresponding first heat-conducting device 12, and is used for converting electrical energy into light. Accordingly, the heat generated by each of the diode light-emitting apparatuses 13 in operation is conducted from the flat end 126 of the corresponding first heat-conducting device 12 via the second part 124 and the first part 122. Therefore, the heat is conducted to and dissipated by the heat-dissipating plate device 11 and the heat-dissipating fins 16.

The hollow barrel 14 is engaged to circumference of the heat-dissipating plate device 11, so as to expose the heat-dissipating fins 16 to air and form an interior space 17 for accommodating the first heat-conducting devices 12 and the diode light-emitting apparatuses 13. The transparent shield 15 is configured to engage to an opening formed by the hollow barrel 14 engaged to the heat-dissipating plate device 11, so as to seal the interior space 17.

According to the preferred embodiment of the invention, the LED illuminating equipment 1 further includes a heat-isolating plate device 18. The heat-isolating plate device 18 thereon has N first through holes 182, and each of the first through holes 182 corresponds to one of the diode light-emitting apparatuses 13. The heat-isolating plate device 18 is disposed in the hollow barrel 14 to separate the interior space 17 into a first room 172 and a second room 174. Therefore, each of the diode light-emitting apparatuses 13 passes through the corresponding first through hole 182 to be disposed in the second room 174. The first parts 122 of the first heat-conducting devices 12 are disposed in the first room 172. Moreover, a gap 1822 formed between the second part 124 of each of the fist heat-conducting devices 12 and the corresponding first through hole 182 is sealed. Accordingly, the heat generated by each of the diode light-emitting apparatuses 13 mostly is isolated by the heat-isolating plate device 18 for preventing the heat from being radiated or conducted to the second room 174. In other words, the heat impact of each of the diode light-emitting apparatuses 13 is highly reduced.

Besides, the LED illuminating equipment 1 further includes N heat-isolating sleeves 19. Each of the heat-isolating sleeves 19 corresponds to one of the first heat-conducting device 12, and covers the second part 124 of the corresponding first heat-conducting device 12. Thereby, the heat generated by the diode light-emitting apparatuses 13 in operation mostly is conducted from the first heat-conducting device 12, and the heat is conducted to and dissipated by the heat-dissipating plate device 11 and the heat-dissipating fins 16. Meanwhile, the heat is prevented from being dissipated to the second room 174 and the third room 176 to enhance the heat-dissipating efficiency.

Moreover, according to the preferred embodiment of the invention, the LED illuminating equipment 1 further includes a heat-isolating ring 20. The hollow barrel 14 is engaged to circumference of the heat-dissipating plate device 11 via the heat-isolating ring 20, and the engagement prevents the heat conducted to the heat-dissipating plate 11 from being conducted to the hollow barrel 14. Therefore, the LED illuminating equipment 1 can be warm at top and cool at bottom, and further the heat-dissipating efficiency is increased. In addition, the heat-isolating ring 20 also can prevent liquid from permeating into the LED illuminating equipment 1, such that the LED illuminating equipment 1 can be water-proof. The hollow barrel 14 is engaged to and locked on circumference of the heat-dissipating plate device 11 by screws, and these screws and lock holes can be further covered with a heat-isolating material. Besides, the circumference of the heat-dissipating plate device 11 and the interior circumference of the hollow barrel 14 can have grooves. And, the hollow barrel 14 can be engaged to circumference of the heat-dissipating plate device 11 by the engagement of grooves. In other words, the heat-isolating ring 20 jackets the grooves on the circumference of the heat-dissipating plate device 11, and then the grooves on the interior circumference of the hollow barrel 14 aligns with and jackets the heat-isolating ring 20.

Figure 5A:
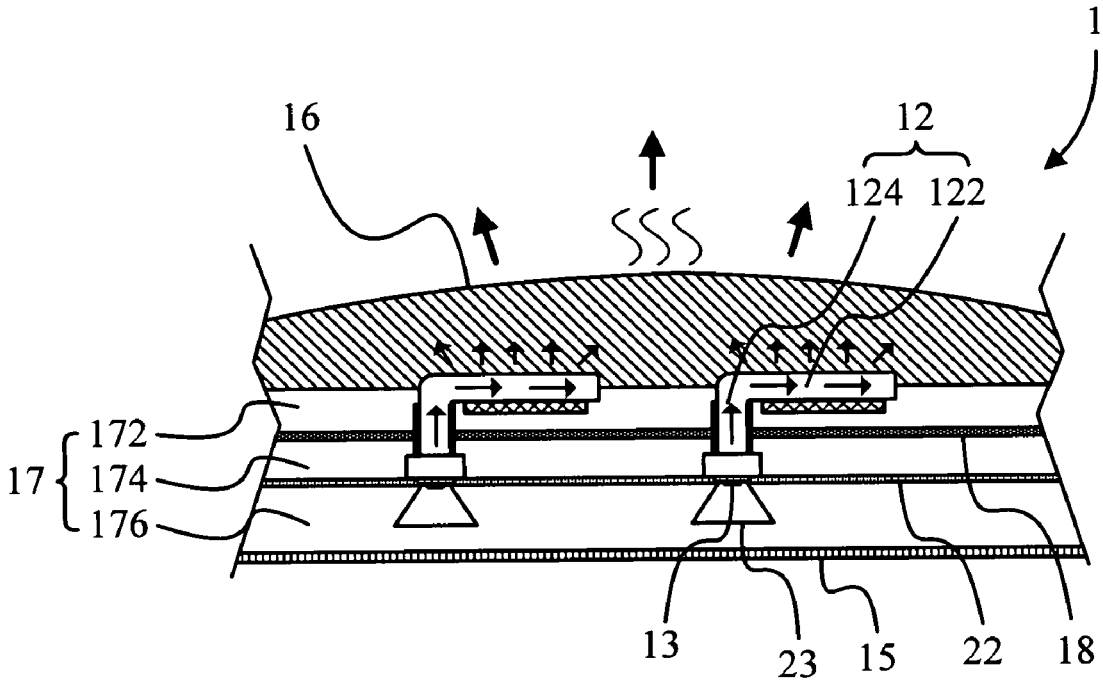
FIG. 5A illustrates heat-dissipating paths of the LED illuminating equipment shown in FIG. 4.

Besides, the first surface 112 of the heat-dissipating plate device 11 of the LED illuminating equipment 1 thereon has N grooves 1122. Each of the grooves 1122 corresponds to one of the first heat-conducting device 12, and the shape thereof matches and tightly contacts the outer surface of the first part 122 of the first heat-conducting device 12. Accordingly, the first heat-conducting device 12 can be tightly mounted on the heat-dissipating plate device 11 to increase heat-dissipating efficiency, as shown in FIG. 5A.

Figure 5B:
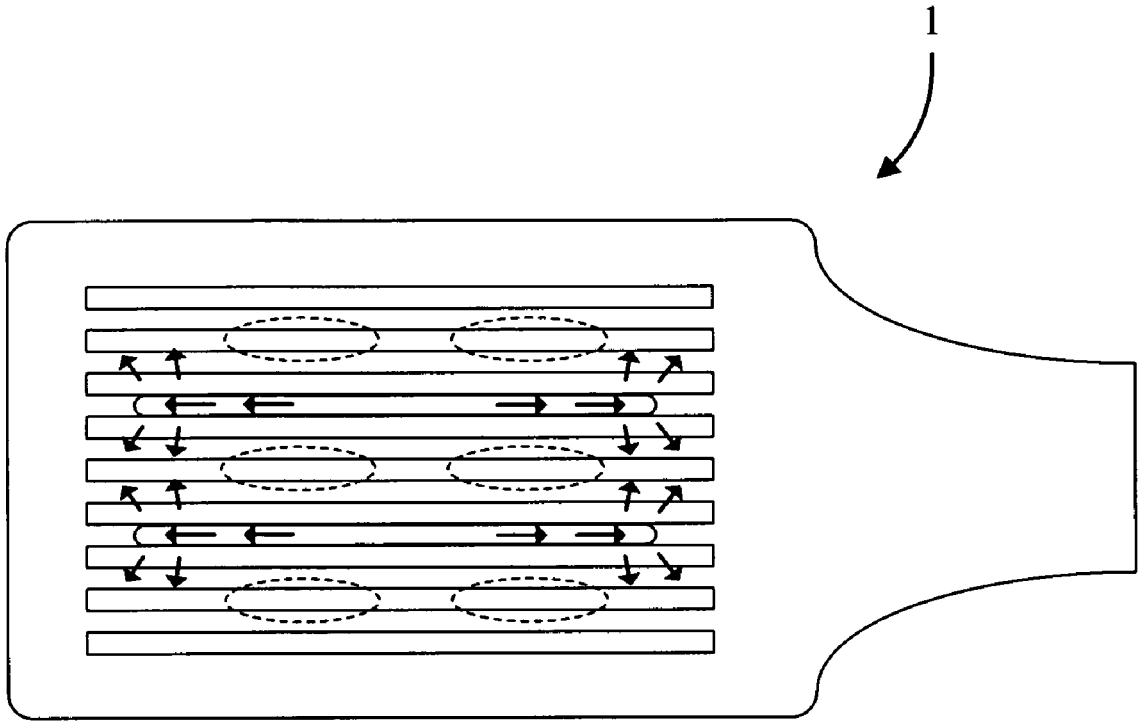
FIG. 5B is a top view of the LED illuminating equipment and illustrates heat-dissipating paths of the LED illuminating equipment.

Additionally, the LED illuminating equipment 1 further includes a number of second heat-conducting devices 21. The second heat-conducting devices 21 are disposed in intervals among the first heat-conducting devices 12, and are mounted on the second surface 114 of the heat-dissipating plate device 11. Therefore, the heat conducted to the heat-dissipating plate device 11 can be uniformly distributed over the heat-dissipating plate device 11. Besides, the heat will not be concentrated on the central of the heat-dissipating plate device 11, and the heat-dissipating efficiency is raised, as shown in FIG. 5B. FIG. 5B is a top view of the LED illuminating equipment 1, and the dotted lines represents the relative position of the first heat-conducting devices 12.

In an embodiment, the first heat-conducting devices 12 and the second heat-conducting devices 21 can respectively be a heat-pipe, a heat-column, a vapor chamber, or other heat-conducting devices. The first heat-conducting devices 12 and the second heat-conducting devices 21 can respectively be made from Cuprum (Cu), Aluminum (Al), or other material with high heat-conductivity.

Figure 6:
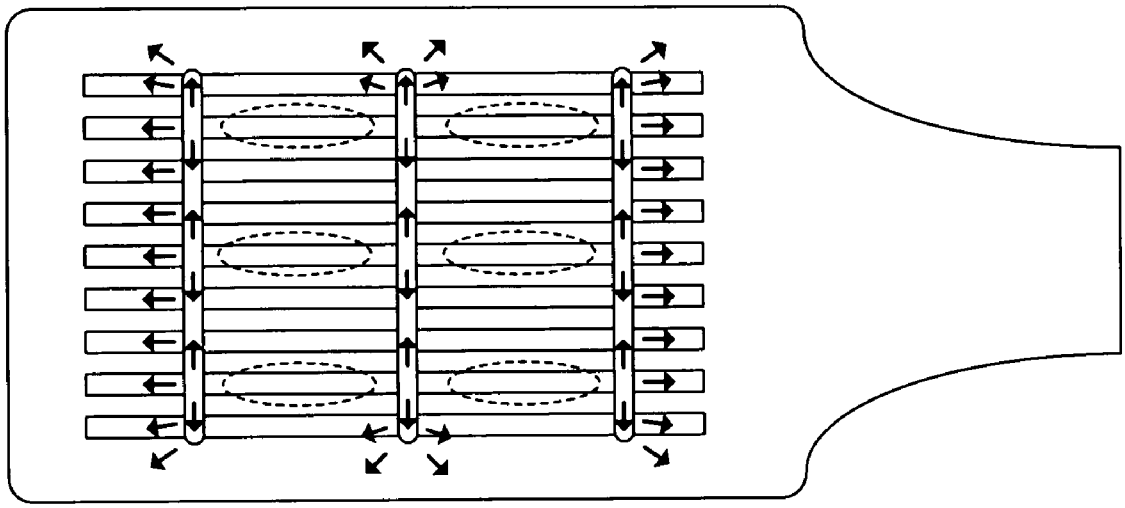
FIG. 6 is a schematic diagram illustrating the LED illuminating equipment with the second heat-conducting devices disposed perpendicular to the heat-dissipating fins.

In addition, the axis of the positions of the second heat-conducting devices 21 relative to the second surface 114 of the heat-dissipating plate device 11 also can perpendicular to the heat-dissipating fins 16, as shown in FIG. 6. In this situation, the heat-dissipating fins 16 must be correspondingly shaped for accommodating the second heat-conducting devices 21. In practical applications, in order to achieve a better heat-dissipating efficiency, the second heat-conducting device 21 can have a different disposition based on the dispositions of the first heat-conducting devices 12 and the heat-dissipating fins 16.

According to the preferred embodiment of the invention, the LED illuminating equipment 1 further includes a partition plate device 22 and N cup-shaped light-reflecting devices 23. The partition plate device 22 thereon has N second through holes 222, and each of the second through holes 222 corresponds to one of the diode light-emitting apparatuses 13. The partition plate device 22 is disposed in the hollow barrel 14 to separate the second room 174 into the second room 174 and a third room 176, such that each of the diode light-emitting apparatuses 13 is disposed in the corresponding second through hole 222, or passes through the corresponding second through hole 222 to be disposed in the third room 176. Light emitted from each of the diode light-emitting apparatuses 13 passes through the corresponding second through hole 222 and toward the transparent shield 15. The partition plate device 22 can assist fixing the diode light-emitting apparatuses 13. According to the preferred embodiment of the invention, the diode light-emitting apparatuses 13 are disposed in the corresponding second through hole 222. Each of the light-reflecting devices 23 corresponds to one of the diode light-emitting apparatuses 13, and is fixed on the corresponding diode light-emitting apparatus 13. The light-reflecting device 23 is used for reflecting the light emitted from the corresponding diode light-emitting apparatus 13 toward the transparent shield 15.

Additionally, according to the preferred embodiment of the invention, the LED illuminating equipment 1 further includes a control circuit (not shown), and the diode light-emitting apparatuses 13 are respectively connected to the control circuit for controlling the diode light-emitting apparatuses to light. The control circuit can be disposed in the hollow barrel 14, and also can be disposed outside of the hollow barrel 14.

In an embodiment, one of the diode light-emitting apparatuses 13 includes at least one LED or at least one laser diode. In another embodiment, each of the diode light-emitting apparatuses 13 includes a white-light LED, a red-light LED, a green-light LED, a blue-light LED, or other LED with monochromatic color; besides, it may also include a LED with RGB mixed-light. Therefore, the control circuit can finely tuning and controlling the diode light-emitting apparatuses 13 to emit the light with different colors, such that the LED illuminating equipment 1 can be widely applied to many applications.

From the description above, the LED illuminating equipment of the invention not only can effectively dissipate heat, but also can uniformly distribute heat generated by the LED in operation and isolate heat out of the light-emitting area. Moreover, the LED illuminating equipment of the invention can prevent liquid permeating itself, and is suitable for a street lighting apparatus. Further, if the diode light-emitting apparatus of the LED illuminating equipment includes a LED with RGB mixed-light, the LED illuminating equipment can emit light with different colors, such that the LED illuminating equipment can be used for other applications except illumination.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A light-emitting diode illuminating equipment, comprising:

a heat-dissipating plate device, comprising a first surface and a second surface;

a plurality of heat-dissipating fins, contacting the second surface of the heat-dissipating plate device;

N number of first heat-conducting devices, each of the first heat-conducting devices being divided into a first part and a second part, the second part comprising a flat area, the first part of each of the first heat-conducting devices being mounted on the first surface of the heat-dissipating plate device, N being a natural number;

N number of diode light-emitting apparatuses, each of the diode light-emitting apparatuses corresponding to one of the N number of first heat-conducting devices and being mounted on the flat area of the corresponding first heat-conducting device for converting an electrical energy into a light;

a hollow barrel, engaged to a circumference of the heat-dissipating plate device, so as to expose the heat-dissipating fins to air and form an interior space for accommodating the first heat-conducting devices and the diode light-emitting apparatuses; and a transparent shield, contacting the hollow barrel to seal the interior space.

2. The light-emitting diode illuminating equipment of claim 1, further comprising a heat-isolating plate device, thereon comprising N number of first through holes, each of the first through holes corresponding to one of the diode light-emitting apparatuses, the heat-isolating plate device being disposed in the hollow barrel to separate the interior space into a first room and a second room, such that each of the diode light-emitting apparatuses passes through the corresponding first through hole to be disposed in the second room, the first parts of the first heat-conducting devices are disposed in the first room, and the heat generated by each of the diode light-emitting apparatuses mostly is isolated by the heat-isolating plate device for preventing the heat from being radiated or conducted to the second room.

3. The light-emitting diode illuminating equipment of claim 2, wherein a gap is formed between the second part of each of the first heat-conducting devices and the corresponding first through hole, and the gap is sealed with a heat-isolating material.

4. The light-emitting diode illuminating equipment of claim 2, further comprising a partition plate device, thereon comprising N number of second through holes, each of the second through holes corresponding to one of the diode light-emitting apparatuses, the partition plate device being disposed in the hollow barrel to separate the second room into the second room and a third room, such that each of the diode light-emitting apparatuses is disposed in the corresponding second through hole, or passes through the corresponding second through hole to be disposed in the third room, and a light emitted by each of the diode light-emitting apparatuses goes through the corresponding second through hole toward the transparent shield.

5. The light-emitting diode illuminating equipment of claim 2, further comprising N number of cup-shaped light-reflecting devices, each of the light-reflecting devices corresponding to one of the diode light-emitting apparatuses and being fixed on the corresponding diode light-emitting apparatus for reflecting a light emitted by the corresponding diode light-emitting apparatus toward the transparent shield.

6. The light-emitting diode illuminating equipment of claim 2, further comprising N number of heat-isolating sleeves, each of the heat-isolating sleeves corresponding to one of the first heat-conducting devices and covering the second part of the corresponding first heat-conducting device.

7. The light-emitting diode illuminating equipment of claim 1, wherein N number of grooves are formed on the first surface of the heat-dissipating plate device, each of the grooves corresponds to one of the N number of first heat-conducting devices and contacts the first part of the corresponding first heat-conducting device.

8. The light-emitting diode illuminating equipment of claim 1, further comprising a plurality of second heat-conducting devices, disposed in intervals among the first heat-conducting devices, and the second heat-conducting devices contacting the heat-dissipating plate device.

9. The light-emitting diode illuminating equipment of claim 8, wherein each of the first heat-conducting devices and the second heat-conducting devices is a heat pipe, a heat column or a vapor chamber respectively.

10. The light-emitting diode illuminating equipment of claim 1, wherein the hollow barrel is engaged to the circumference of the heat-dissipating plate device via a heat-isolating ring, so as to isolate the heat conducted to the heat-dissipating plate device and prevent the heat from being conducted to the hollow barrel.

11. The light-emitting diode illuminating equipment of claim 1, wherein one of the N number of diode light-emitting apparatuses comprises at least one light-emitting diode or at least one laser diode.

12. The light-emitting diode illuminating equipment of claim 1, further comprising a control circuit, electrically connected to the diode light-emitting apparatuses respectively for controlling the diode light-emitting apparatuses to light.

13. The light-emitting diode illuminating equipment of claim 12, wherein the control circuit is disposed in the hollow barrel.

14. The light-emitting diode illuminating equipment of claim 12, wherein the control circuit is disposed outside of the hollow barrel.

15. The light-emitting diode illuminating equipment of claim 1, wherein a heat generated by each of the diode light-emitting apparatuses in operation is conducted from the corresponding first heat-conducting device to the heat-dissipating plate device and the heat-dissipating fins so as to be dissipated by the heat-dissipating plate device and the heat-dissipating fins.

16. The light-emitting diode illuminating equipment of claim 1, wherein the flat area of the second part of each of the first heat-conducting devices is on an end of the first heat-conducting device.

* * * * *